US006059022A

United States Patent [19]

Wilson

[11] Patent Number: 6,059,022

[45] Date of Patent: May 9, 2000

[54] STEAM GENERATION WITH TUBE SUPPORT

[75] Inventor: Robert McConaughy Wilson, Cantonment, Fla.

[73] Assignee: Westinghouse Electric Company LLC, Pittsburgh, Pa.

[21] Appl. No.: 09/023,377

[22] Filed: Feb. 13, 1998

Related U.S. Application Data

[60] Provisional application No. 60/038,192, Feb. 14, 1997.

[51] Int. Cl.[7] ..... F28D 7/00

[52] U.S. Cl. ..... 165/162; 165/172; 165/178; 165/159

[58] Field of Search ..... 165/159, 162, 165/172, 178

[56] References Cited

U.S. PATENT DOCUMENTS 4,143,709 3/1979 Cunningham ..... 165/162
4,709,756 12/1987 Wilson et al. ..... 165/172

*Primary Examiner*—Ira S. Lazarus
*Assistant Examiner*—Terrell McKinnon

[57] ABSTRACT

A steam generator tube support plate has passageways with inwardly extending lands. Two or more tubes extend through the passageways and are supported by the lands. The tube support plates are variably spaced to provide additional support near the tubesheet and in the distal bends of U-tube bundles. This design provides reduced clogging, pressure drops and tube vibrations.

6 Claims, 5 Drawing Sheets

STEAM GENERATION WITH TUBE SUPPORT

This Application claims the benefit of U.S. Provisional Application Ser. No. 60/038,192 filed Feb. 14, 1997.

BACKGROUND OF THE INVENTION

The invention relates to a steam generator having a tube bundle with at least one shell side tube support and, more particularly, to a steam generator with a shell side tube support designed for increased fluid flows on the shell side with lower pressure drops, lower vibration and reduced corrosion.

Steam generators employed to generate electric power may circulate water through the shell side of the steam generator over a tube bundle in order to generate steam on the shell side. The tubes in these steam generators may be either U-tubes or straight tubes and must be mechanically supported as a tube bundle by one or more intermediate tube support plates. In early steam generator designs, each tube in a bundle extended through a separate drilled hole in each intermediate tube support plate and the tube bundles were susceptible to corrosion and the deposition of sludge in the region between the tubes and the support plate.

U.S. Pat. No. 4,143,709 to Cunningham discloses a modified steam generator design for use in connection with a pressurized water nuclear plant wherein high temperature, high pressure water is circulated between a reactor vessel and the tube side of a steam generator for generating steam on the shell side. The Cunningham design was developed to reduce the formation of shell side sludge deposits in the regions between the tubes and tube support plates. This particular design differed from the earlier conventional design in that it mechanically supported multiple tubes in the holes in the support plates. Although this design exhibited improved resistance to sludge deposition, it also exhibited a higher than expected pressure drop and a flow stagnation region in the corners formed by the tube support plates where sludge deposition may extend up to about 120° of the tube circumference.

U.S. Pat. No. 4,709,7565 to Wilson discloses a later steam generator design which has been commercially successful. The Wilson design returned to the one hole/one tube approach and in addition broached the support plates to provide flow areas between inwardly extending lands which engage the tubes extending through the holes. This later design provided reduced pressure drops and, at least initially, reduced the flow stagnation regions to no larger than about 40° of the tube circumference. However, experience has indicated that the flow areas along the tubes between the inwardly extending lands may be susceptible to clogging by entrained corrosion particles or sludge.

SUMMARY OF THE INVENTION

Thus, it is an object of the present invention to provide a steam generator design having lower shell side pressure drops with smaller flow stagnation regions and larger flow areas within individual tube support intersections. It is a further object of the present invention to provide a design having reduced tube vibration. Larger holes with multiple tubes are less able to crush tubes than single tube holes. Lateral loads (seismic for example) in single hole designs can crush peripheral tubes when the plate yields under load. This reduces the tube internal flow area and restricts flow to the reactor core.

With these objects in view, the present invention relates to a steam generator having at least one tube support plate defining a passageway with land portions extending into the passageway and with a plurality of tubes extending through the passageway and engaging the land portions. Preferably, the steam generator has a plurality of variably spaced apart tube support plates along the axis of the tubes in a bundle for providing relatively more support where there are high loads on the tubes such as in highly turbulent areas (near the tube sheet where the feedwater enters or exits the tube bundle) or near the bends of U-tubes and for providing relatively less support in the other areas. Advantageously, this design supports the tubes against mechanical and hydraulic loads while providing a smaller area which is susceptible to sludge deposition and corrosion which obstructs flow.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
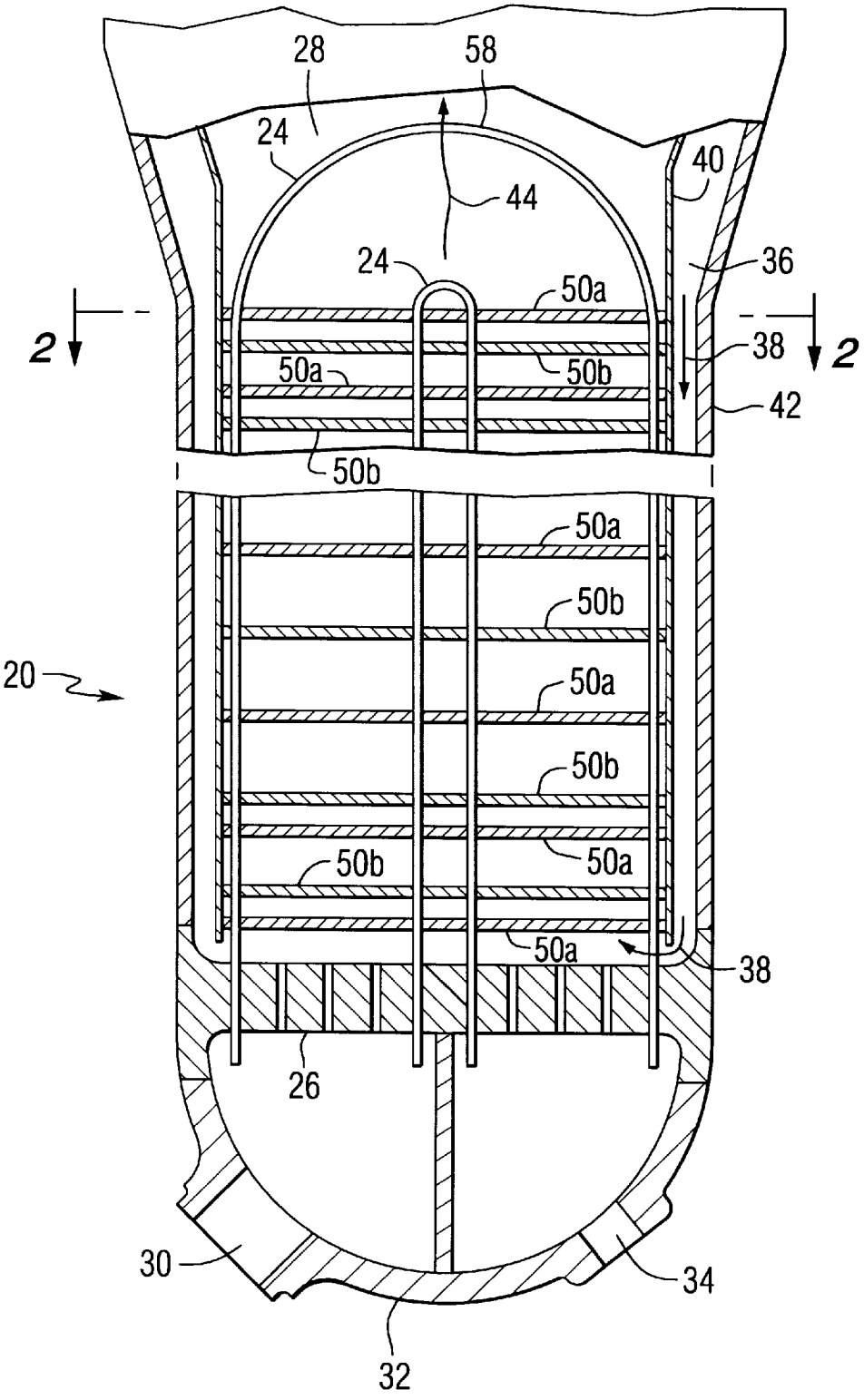
FIG. 1 is a schematic representation of the lower portion of a conventional steam generator having a vertical tube bundle.

Referring now to the drawings in detail and in particular to FIG. 1 there is shown the lower portion of a steam generator 20 of the type commercially provided by the assignee of the present invention. The steam generator has U-tubes 24 attached to a tubesheet 26 for transferring heat from hot water circulating through the tubes 24 to generate steam on the shell side 28 of the steam generator 20. Hot water (known as "reactor coolant") from a reactor vessel hot leg (not shown) enters an inlet nozzle 30 in a channel head 32, circulates through the U-tubes 24 and out through an outlet nozzle 34 in the channel head 32 and then back to the reactor vessel. Feedwater on the shell side flows (as is indicated by flow arrows 38) downwardly through a downcomer area 36 between a tube bundle wrapper 40 and the shell 42 of the steam generator 20 and then into the tube bundle near the tube sheet 26. The feed water is heated and vaporized as it flows upwardly through the bundle and then flows upwardly as wet steam (as indicated by flow arrow 44) toward moisture separators and dryers (not shown) in the upper portion of the steam generator 20 and then as dry steam to turbines for generating the electric power.

Figure 2:
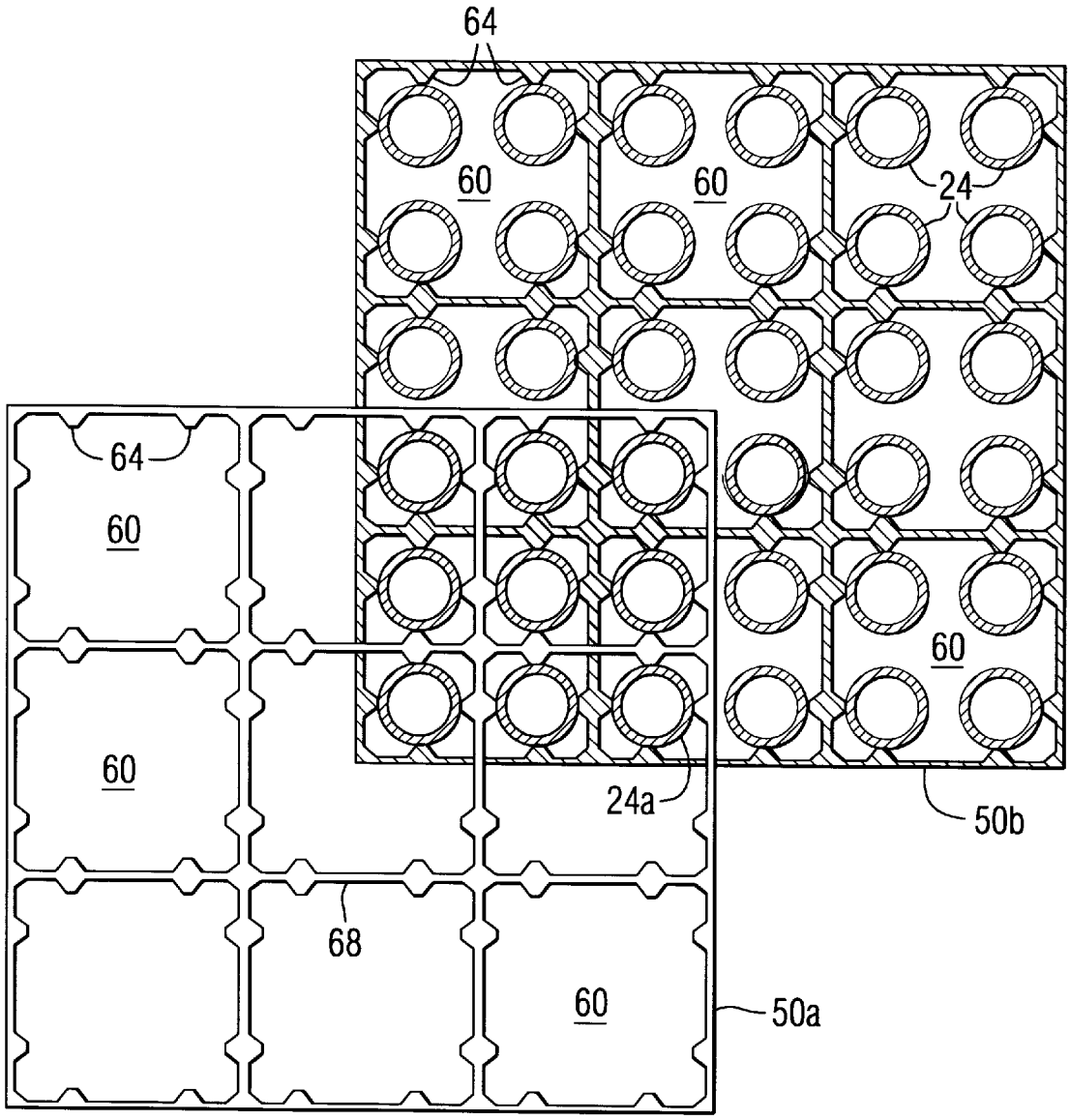
FIG. 2 is a schematic plan view of two tube support plates embodying the present invention with tubes extending therethrough generally taken along line 2—2 of FIG. 1.

The tubes 24 of the tube bundle are mechanically supported by one or more tube support plates 50*a* and 50*b*. (Alternatively, in other steam generator designs tube-contacting grids may be made from bars assembled in an integral plate design in place of tube support plates 50*a* and 50*b*.) Plates 50*a* and 50*b* are substantially identical. However, the plates 50*a* and 50*b* are arranged in the steam generator 20 to engage the tubes 24 on opposite sides. Thus, e.g., as shown in FIG. 2, each plate 50*a* engages tubes 24 (represented by tube 24*a*) at 0° and at 90° whereas each plate 50*b* engages tube 24*a* at 180° and at 270°. The support plates 50*a* and 50*b* may be maintained in spaced apart relation by one or more stay rods 52 (shown in FIG. 3), sandwiched between two wrapper welds 54 and/or wedged against the wrapper 40 by wedges 56 in accordance with known current practices.

As is shown in the preferred embodiment of FIG. 1, the tube support plates 50*a* and 50*b* may be more closely spaced near the tube sheet 26 and near the cantilevered U-bends 58. Preferably, the support plates 50*a* and 50*b* are closely spaced where there are high mechanical loads (such as near the U-bends) or where there are high hydraulic forces (such as where the fluid flows into tube bundle) Thus, in these regions, the plates may be spaced from about 2 to about 8 inches in order to provide relatively more mechanical support against lateral movement and vibration. The intermediate plates in the tube bundle shown in FIG. 1 may be spaced up to 20 inches or more in accordance with present commercial designs. It is noted however that spacing adjacent plates 50*a* and 50*b* on, e.g., 20 inch centers provides a distance of 40 inches between supports on the same side of the tubes 24.

In another embodiment (not shown), closely spaced plates 50*a* and 50*b* may be closer than 2 inches or less and may even contact (and reinforce each other), but such designs may be more susceptible to clogging under some conditions when, e.g., sludge or corrosion settles against a tube 24 and is trapped during a shutdown or standby situation. In another embodiment (not shown), the tube supports 50*a* and 50*b* may be substantially equidistantly spaced in accordance with known current designs.

Figure 3:
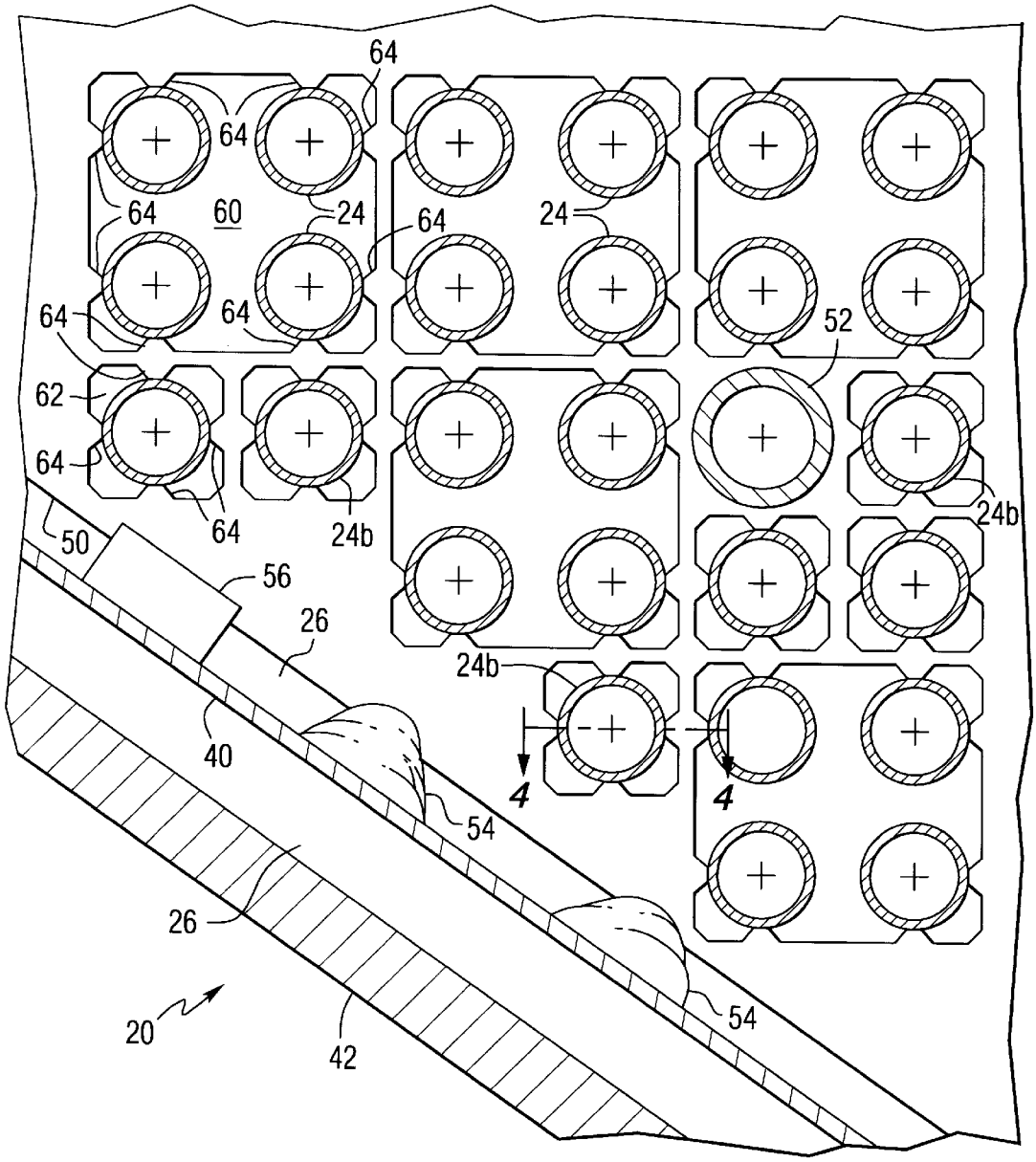
FIG. 3 is an enlarged plan of a portion of a tube support plate of FIG. 2.
Figure 4A:
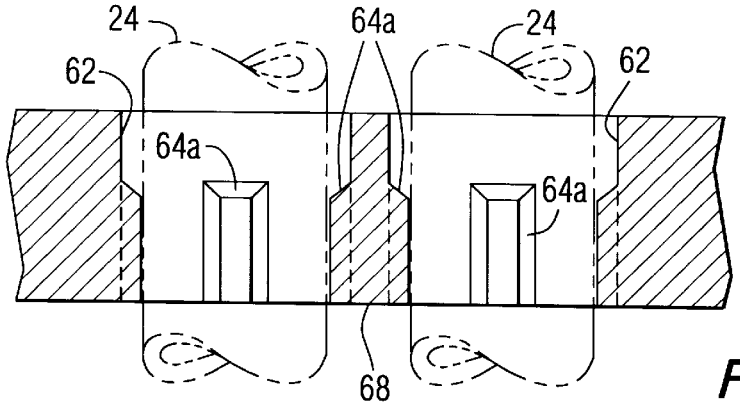
FIGS. 4*a* and 4*b* are schematic cross sectional views of tubes in two single tube holes in a tube support plate.
Figure 4B:
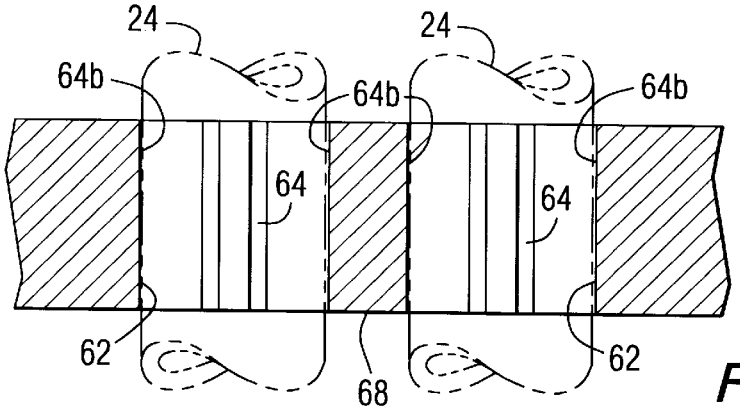
Figure 5F:
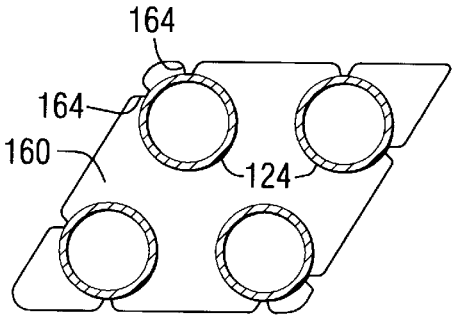
FIGS. 5*a*–5*f* are schematic plan views of tubes on triangular pitches extending through single tube, two tube and four tube holes in a tube support plate.
Figure 5D:
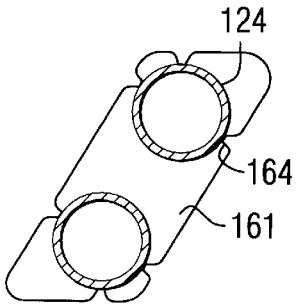
Figure 5B:
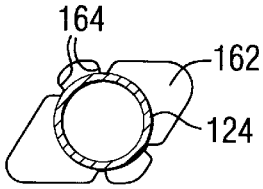
Figure 5E:
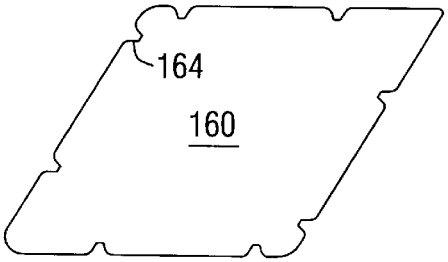
Figure 5C:
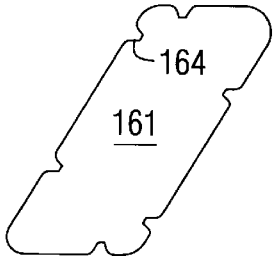
Figure 5A:
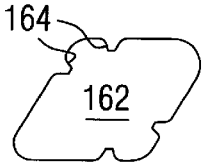

As is shown in FIG. 3, most of the tubes 24 extend through large passageways 60 and other tubes (represented by tubes 24*b*) which cannot be supported by the large passageways 60 extend through smaller passageways 62 in the tube support plates 50*a* and 50*b*, and all of the tubes 24 engage lands 64 extending inwardly into the passageways 60 and 62. The lands 64 may extend part of the thickness of a tube support plate 50*a* or 50*b* (as is shown by representative lands 64*a* in FIG. 4*a*) or may extend the entire thickness of the plates 50*a* and 50*b* (as is shown by representative lands 64*b* in FIG. 4*b*). FIGS. 4*a* and 4*b* show tubes 24 in single tube holes 62. Similarly, a larger passageway 60 for more than one tube 24 as shown in FIG. 3 would essentially comprise the adjacent support plate holes 62 of FIG. 4 without the intermediate ligaments 68 (and their inwardly extending lands 64). The above mentioned U.S. Pat. No. 4,143,709 to Cunningham and U.S. Pat. No. 4,709,756 to Wilson are hereby incorporated by reference for their disclosure of the structure and function of multiple tube passageways and of broached tube support plates with lands 64, respectively.

Figure 6:
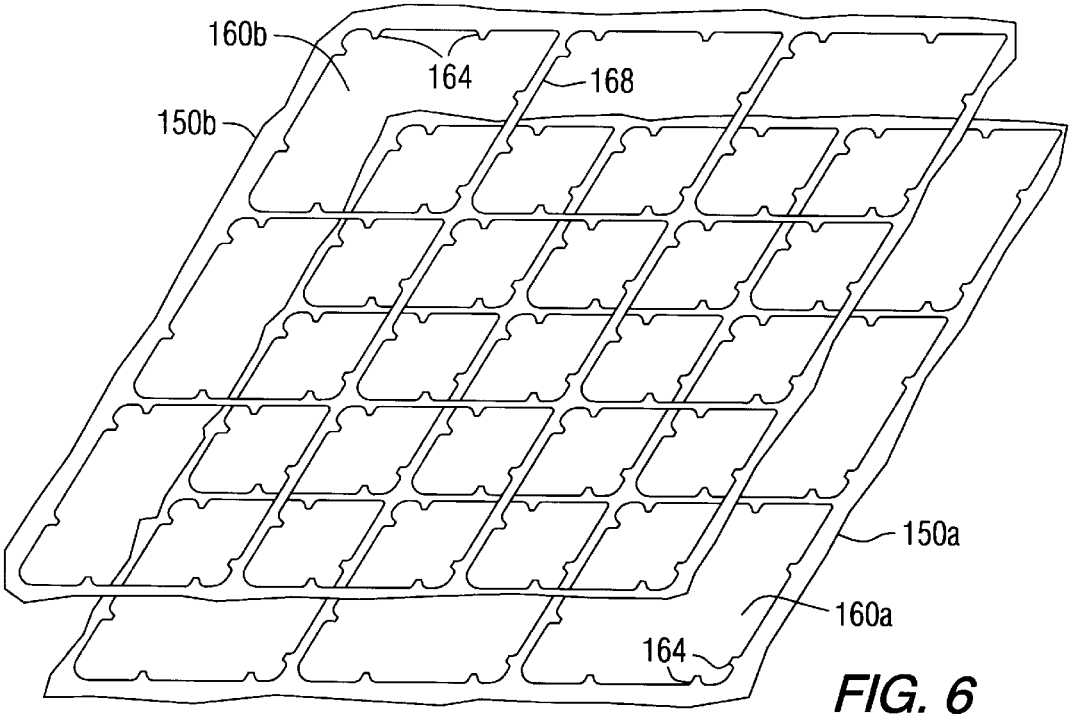
FIG. 6 is a schematic plan view of staggered passageways for two tube support plates for tubes on triangular pitches.
Figure 7:
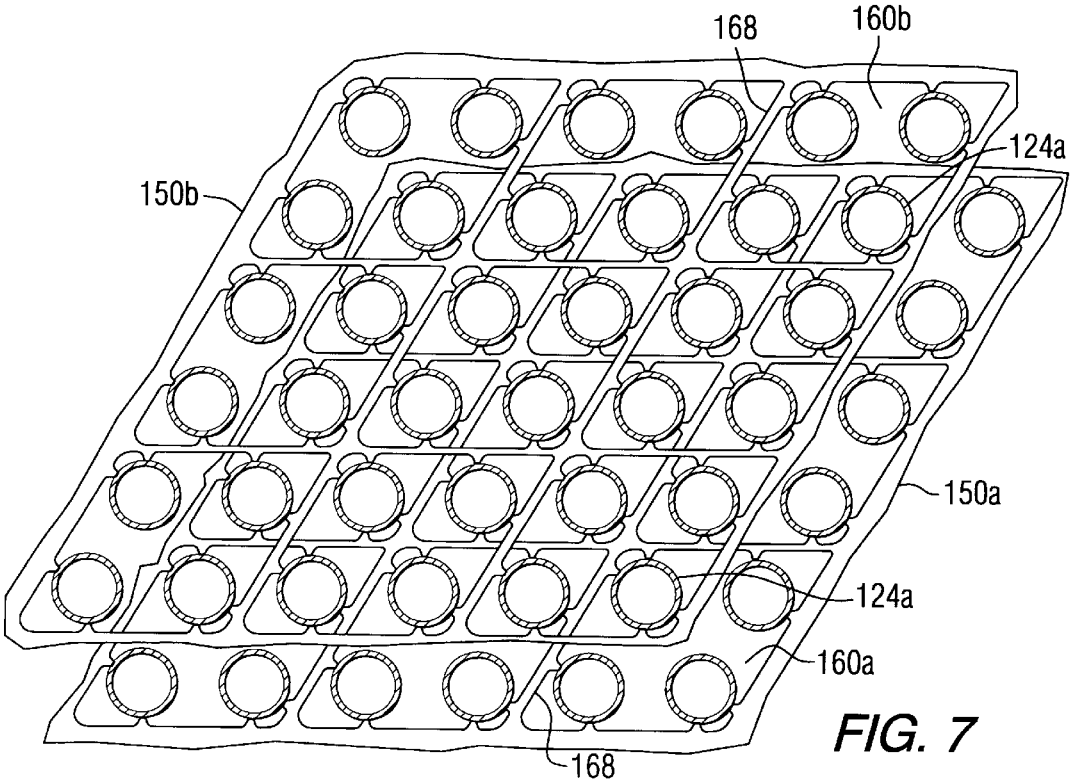
FIG. 7 is a schematic plan view of the two support plates of FIG. 6 with tubes extending therethrough.

As FIGS. 2–4 indicate, the plates 50*a* and 50*b* may have large passageways 64 which support tubes 24 on square pitches. FIGS. 5–7 show how tubes 24 on triangular pitches may be supported in large passageways 160 having inwardly extending lands 164. FIGS. 5*a*–5*f* schematically show a representative passageway 160 with lands 164 for engaging four tubes 124, a representative passageway 161 with lands 164 for engaging two tubes 124 and a representative passageway 162 with lands 164 for engaging one tube 124. FIG. 6 shows two staggered tube support plates 150*a* and 150*b* having large passageways 160*a* and 160*b*, respectively.

The large passageways 60 and 160 of adjacent tube support plates 50*a* and 50*b* and 150*a* and 150*b* are staggered so that the lands 64 and 164 of the adjacent plates 50*a* and 50*b* and 150*a* and 150*b* engage each tube 24 and 124 on opposite sides thereof in order to sufficiently support the tubes 24 and 124 and ligaments 168 of plates 150*a* and 150*b* against lateral movement while increasing the total flow area and dramatically reducing it's pressure drop (flow resistance)—small increases in area yield large reductions in flow resistance. In addition, there is substantially less cross-sectional area of the support plates obstructing the flow of steam and water through the lower section of the steam generator; e.g., where the ligaments 168 have a width dimension extending between adjacent passageways, and the lands extend on either side therefrom into the adjacent passageways at least about half of the width of the ligament, the cross-sectional area of the support plate can be reduced on the order of about 40% or more. Thus, although the ligaments 68 and 168 of the support plates 50*a* and 50*b* and 150*a* and 150*b* are not as wide as the Cunningham ligaments (by the width of two lands 64) and are about half the total number of the Wilson ligaments, the spacing of adjacent plates 50*a* and 50*b* and 150*a* and 150*b* can be adjusted to meet the design loads. Advantageously, at very high lateral loadings which might cause the tube support structure to yield, the yield points of two closely spaced plates 50*a* and 50*b* and 150*a* and 150*b* are offset from each other with a higher maximum load carrying capacity. Thus, the tubes 24 and 124 are able to displace larger distances without being crushed. Also, in a preferred embodiment where certain adjacent plates 50*a* and 50*b* and 150*a* and 150*b* are only a few inches apart, e.g., about 2 to 3 inches apart, the two support elevations will tend to increase the tube natural frequency (i.e., eliminate low frequency vibrations) and enhance vibration margin).

Advantageously, the combination of enlarged flow areas between the lands 64 and 164 and the tubes 24 and 124 combined with the enlarged area between the multiple tubes 24 and 124 in passageways 60 and 160 provides a flow pattern around the tubes 24 and 124 which results in increased flow rates at lower pressure drops and lower sludge deposition rates around the tubes 24 and 124. Increased flows provide relatively more water as the steam is generated so that there are fewer hot spots on the tube surfaces and less deposition on the tube surfaces. A net improvement in pressure drop of up to as much as 50% or more over prior art circular and broached single hole designs and over the Cunningham design can be expected.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. The steam generator of claim 1, comprising:

a second tube support plate defining a second passageway with lands extending into the passageway and with the tubes extending through the second passageway and engaged with the lands in the second passageway;

a third tube support plate defining a third passageway with lands extending into the passageway and with the tubes extending through the third passageway and engaged with the lands in the third passageway; and wherein the first and second tube support plates are spaced by a first dimension and the second and third tube support plates are spaced by a second dimension which is greater than the first dimension.

2. The steam generator of claim 1, wherein the second and third tube support plates are spaced by about 20 inches.

3. The steam generator of claim 1, wherein the first and second tube support plates are spaced by about 2 inches to 8 inches.

4. The steam generator of claim 1, wherein the first and second tube support plates are spaced by about 2 inches to about 3 inches.

5. The steam generator of claim 4, wherein the first and second tube support plates are spaced by about 2 inches.

6. The steam generator of claim 1, wherein the first tube support plate contacts the second tube support plate.

* * * * *